US005317905A

United States Patent [19]

Johnson

[11] Patent Number: 5,317,905

[45] Date of Patent: Jun. 7, 1994

[54] REFRIGERATION SYSTEM

[76] Inventor: H. James Johnson, 1221 Lemonds Dr., Quilcene, Wash. 98376

[21] Appl. No.: 956,355

[22] Filed: Oct. 5, 1992

[51] Int. Cl.[5] ..... F25B 1/00

[52] U.S. Cl. ..... 62/100; 62/268/116; 416/120

[58] Field of Search ..... 62/86, 100–116, 62/268–270, 498, 500; 416/DIG. 2, 120

[56] References Cited

U.S. PATENT DOCUMENTS

| | | | |
|---|---|---|---|
| 1,565,795 | 12/1925 | Coffey | 62/86 |
| 1,765,657 | 6/1930 | Coffey | 62/500 |
| 1,972,705 | 9/1934 | Crosthwait | 62/500 |
| 2,014,701 | 9/1935 | Seligmann | 62/500 |
| 2,130,549 | 9/1938 | Kirgan | 62/100 |
| 2,199,123 | 4/1940 | Whitney | 62/500 |
| 2,616,614 | 11/1952 | Plummer | 62/86 |
| 2,852,922 | 9/1958 | Neumann et al. | 62/500 |
| 3,277,660 | 10/1966 | Kemper et al. | 62/116 |
| 3,621,667 | 11/1971 | Mokadam | 62/116 |
| 3,973,872 | 8/1976 | Seleznev et al. | 416/DIG. 2 |
| 4,218,891 | 8/1980 | Schwartzman | 62/116 |
| 4,336,693 | 6/1982 | Hays et al. | 62/116 |
| 5,216,899 | 6/1993 | Fabris | 62/324.6 |

FOREIGN PATENT DOCUMENTS

| | | | |
|---|---|---|---|
| 1137037 | 9/1962 | Fed. Rep. of Germany | 62/86 |
| 4028982 | 1/1992 | Japan | 62/86 |

*Primary Examiner*—Henry A. Bennet
*Assistant Examiner*—William C. Doerrler

[57] ABSTRACT

A refrigeration system where the refrigerant starts out as a liquid at ambient temperatures and pressures and is expanded to a very low pressure and temperature through the use of a special design ejector and pump assembly. The preferred design uses a new type of centrifugal pump which is designed to produce a high velocity discharge rather than pressure. The refrigerant in expanding to a gas extracts BTU's from its surroundings.

4 Claims, 2 Drawing Sheets

REFRIGERATION SYSTEM

FIELD OF THE INVENTION

My invention relates to improvements in the art of refrigeration and particularly to an improvement where a liquid operated ejector and a pump are used to create a vacuum in a refrigeration system.

BACKGROUND OF THE INVENTION

Present practice where the ejector is operated by a liquid, the pressure of the operating liquid is first built up by the pump and then is accelerated by expanding it thermodynamically through the ejector operating jet to produce a high velocity and low pressure fluid. The rest is obvious. The problem is that there is a loss of efficiency by first build up of the pressure of the ejector operating fluid and then getting all your velocity through the expansion through the ejector operating jet.

My invention bypasses the step of building up the pressure and uses the centrifugal pump only to accelerate the liquid before the final acceleration in the ejector operating jet. It also happens that the mechanical acceleration of the operating liquid by the centrifugal pump is more efficient than what you would have by expanding the liquid from a high pressure through a nozzle.

My invention further uses the centrifugal pump in way that it has never been used before and that is to not use it to build up pressure or to pump volume but to use it exclusively to increase the velocity of the liquid that is to be the operating fluid of the ejector. It is done mechanically, not thermodynamically as expansion through a nozzle. The final acceleration is done by the expansion of the operating liquid through the ejector operating jet to the high suction vacuum.

A further part of my invention is to use some of the waste heat still in the refrigerant returning to the evaporator to add extra energy to the fluid that is being expanded in the ejector operating jet by use of a heating jacket around the operating jet. Heat at this point helps with the acceleration through the jet.

SUMMARY OF THE INVENTION

The refrigerating system based on this invention would not use any ozone-destroying refrigerant and would be more energy efficient. Water could be used as a refrigerant. This system would employ a newly designed centrifugal pump which would not have cavitational losses or losses due to turbulence as with present centrifugal pumps. Because the liquid would be accelerating throughout the pump and would continue to accelerate as it discharges into the ejector power jet, the losses would not occur as they do when the centrifugal pump is designed to produce a discharge pressure.

The ejector is of a new design also. The power jet is designed to change the liquid entering the jet at very high velocities to a liquid/gas mixture. The high velocity fluid entering the power jet accelerates to near sonic velocities as it approaches the high vacuum of the suction. The power jet also reclaims some of the energy ordinarily lost to the atmosphere by using some of the heat from the ejector discharge to super charge or further accelerate the fluid passing through the power jet.

The delivery jet is also of a new design. The entrainment part of jet is designed to entrain the gas from the suction, with minimum loss, into the delivery jet mixing it with the near sonic velocity operating fluid. The mixture which would be homogeneous once in the delivery jet, would de-accelerate, increase in pressure and change back to a very hot liquid. While the entrainment part of the delivery jet would be conventional, the compression part of the delivery jet would be an entirely new design due to the gas changing to liquid as well as increasing in pressure.

The suction of the ejector produces a high vacuum in the evaporator section which causes any liquid in there to boil at a very low temperature (32 degrees or below). The boiling liquid removes BTU's out of the liquid and reduces its temperature to the boiling point for that pressure. By heat exchange anything in contact with the heat exchange surface has its temperature reduced.

The discharge from the ejector goes to cooling coils where it is either air cooled or water cooled. Part of the discharge from the cooling coils returns to the centrifugal pump and part is expanded through a variable orifice valve into the evaporator. The variable orifice valve would control the vacuum and therefore, the temperature in the evaporator.

The cooling coils would have an expansion tank allowing for a variation in volume during operation and when the system is originally started up. The cooling coils are also of special design. The tubing has square fins that are attached on the two opposite sides to two vertical sheet metal walls which form a chimney. The multi tubes are horizontal between two headers which close the ends of the two sheet metal walls while leaving the top and bottom open. This creates the perfect chimney where the air is heated all the way to the top. This creates a sizeable draft passing through the fins and around the tubes which super air cools the hot refrigerant. After passing through the cooling coils, part of the flow will then discharge to the centrifugal pump. The part of flow that does not go back to the centrifugal pump is by-passed to give part of its remaining heat to the power jet before going to the variable orifice valve to change back to a very low pressure, low temperature, gas in the evaporator. The heating of the power jet helps create high velocity low pressure gas which accelerates the remaining liquid to a velocity that it could not attain through pressure drop. This gives the power jet a driving force that would not otherwise be possible.

The present design of ejector can approach a very good vacuum. With the proposed design the results would be much better. The present design of ejector has a loss in vacuum due to the pressure drop that the suction fluid takes in approaching the operating fluid. As a result it is not advisable to accelerate the suction fluid before it meets the operating fluid. The loss of energy should be taken only where there is an excess. Since we have given the operating fluid plenty of energy and force, this is where the loss is affordable. For the same reason, check valves are not put in the suction of the ejector. To maintain the vacuum when the pump is not operating, use a full throated electrically operated valve in the centrifugal pump section, a check valve in the ejector discharge and the "shut off" position of the variable orifice valve.

THE REFRIGERATION ASSEMBLY

Figure 1:
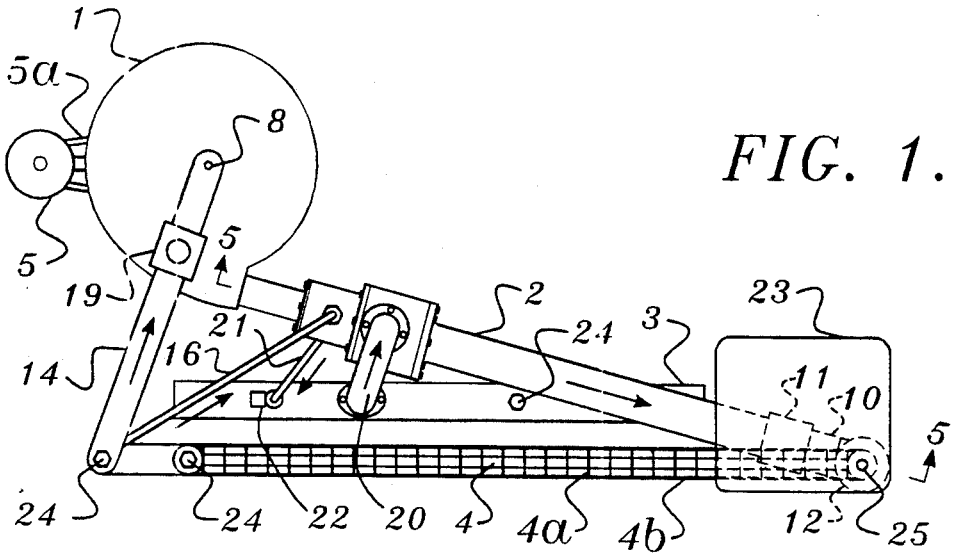
FIG. 1 is a diagram showing the top view of a suggested assembly of the refrigeration system in accordance with the teachings of the subject invention.
Figure 2:
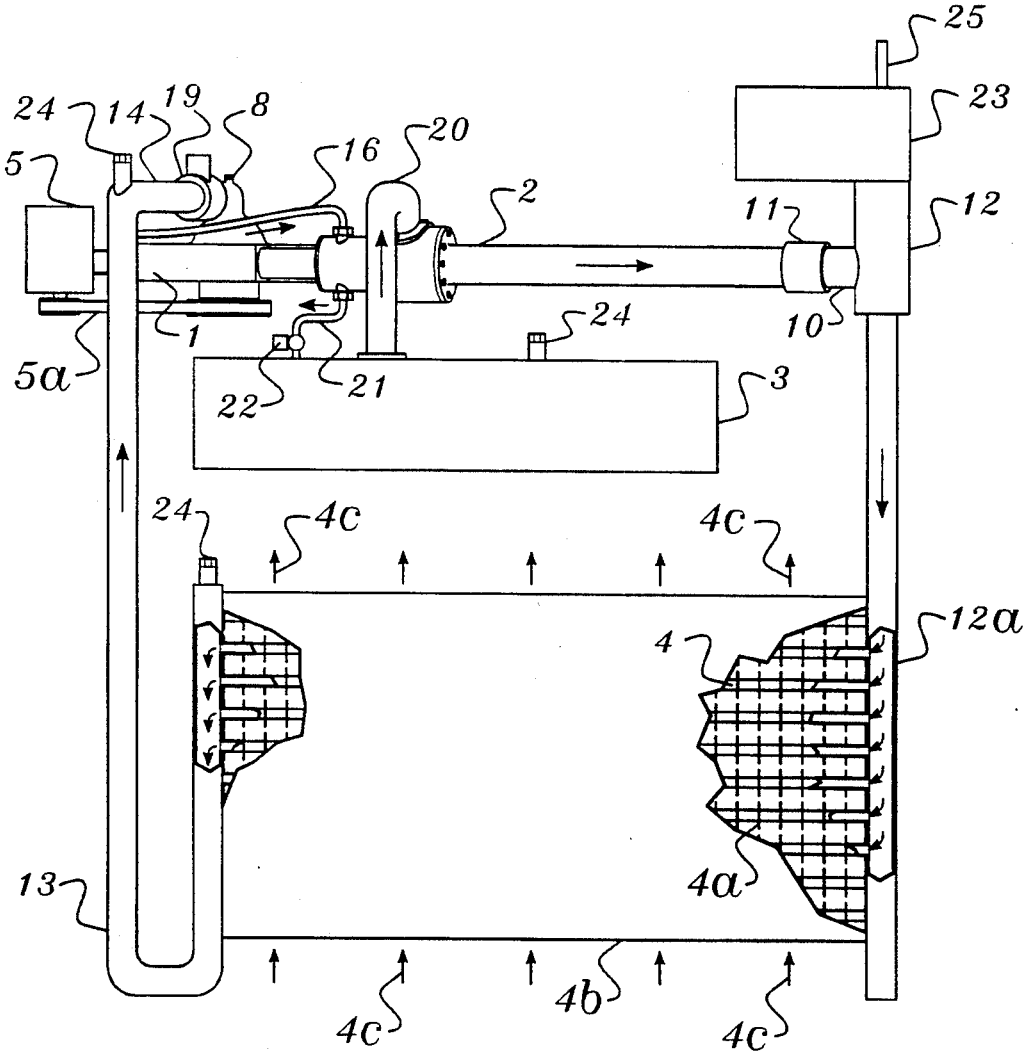
FIG. 2 is a diagram showing the front view of a suggested assembly of the refrigeration system in accordance with the teachings of the subject invention.

FIGS. 1 and 2

A refrigeration system according to this invention is shown generally by FIG. 1. It is comprised of a centrifugal pump (1), an ejector (2), an evaporator (3), cooling coils (4) and the necessary parts for its operation.

The centrifugal pump is driven by an electric motor (5) through a belt drive. The inlet to the centrifugal pump is (6) and the discharge is (30). The system is filled with refrigerant through a fill plug at (8) while doing any necessary venting at (24 and 25). The centrifugal pump discharges to the ejector. The details of the construction and operation of the pump are described in FIG. 3. The details of the construction and operation of the ejector are described in FIG. 3. The ejector discharges at (43) to a pipe (10) leading to the header (12). There is a check valve (11) in pipe (10) which helps maintain the vacuum in evaporator (3). Pipe (10) discharges into header (12). The cooling coils (4) run between header (12) and (13). Pipe (14) takes the major portion of the refrigerant in header (13) and sends it back to the inlet of the centrifugal pump (6). There is an electrically driven valve (19) in pipe (14) that closes when the centrifugal pump is not operating. While the centrifugal pump is powering the ejector, an extremely high vacuum is created in the ejector suction (20) which evacuates the evaporator (3) causing boiling of the liquid refrigerant in the evaporator. The boiling absorbs BTU's and cools the remaining liquid as well as everything exposed to the evaporator. In other words, the evaporator becomes the cooling surface or cooler for the refrigeration system. After the power jet heating jacket (17) has removed additional heat from the refrigerant passing through pipe (16) the refrigerant goes to the variable orifice valve (22) through pipe (21). The variable orifice valve is operated electrically and controls the amount of refrigerant going to the evaporator. The variable orifice valve is controlled both by pressure and temperature. It remains closed until the vacuum in the evaporator gets down to a pre-set vacuum and then opens when the temperature in the evaporator is above a given set point. It opens to a pre-set position which gives an opening that allows the refrigerant to enter at a rate that is less than what the ejector can pump out and still maintain the given vacuum.

The header (12) provides an entrance to multi cooling coils of relatively small diameter giving them a lot of radiating area per cross-sectional area of the tube. The great number of tubes or cooling coils adds up to a sizable cross-sectional area to where it doesn't require a very high flow velocity in each tube to handle the required volume of refrigerant. As a result, there would not be a large pressure drop through the tubes. The cooling coils get additional radiating area from the square fins and the sheetmetal walls. A chimney effect is created which causes a high velocity of air to move through the fins and around the tubes. Since it is a chimney where the air is being heated all the way up, there will be a greater draft and velocity than with an ordinary chimney. This is new also.

The evaporator would be sized by the radiating area to absorb the BTU's required. However, there would be an advantage to have extra volume for refrigerant. It would help prevent super heat and the variable orifice valve would not have to open as often.

Expansion tank (23) takes care of the extra refrigerant the system has that needs to be stored when the system is started up. It also takes care of the variations in volume during operation. Before start-up, the system is flooded. When the system is started, the ejector evacuates part of the evaporator as well as the ejector suction. This all goes to the expansion tank. The expansion tank is vented at (25).

While water is suggested as a possible refrigerant, there are other liquids that will boil at higher absolute pressures at a given temperature such as 32 degrees F. that might be preferable. If water is used as the refrigerant, it might be advisable to add alcohol to keep it from freezing.

CENTRIFUGAL PUMP

Figure 4:
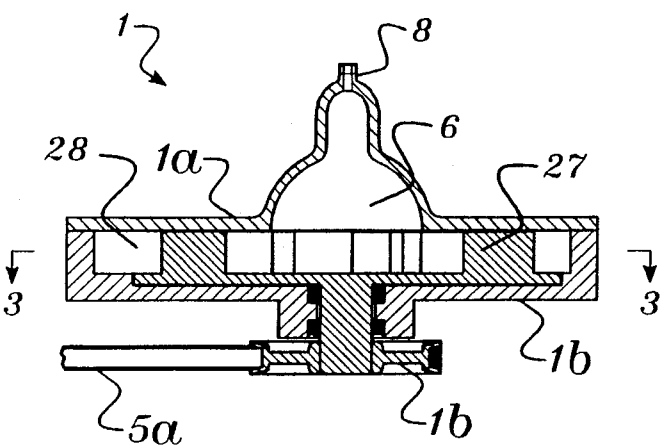
FIG. 4 shows only the front cutaway view of the centrifugal pump in accordance with the teachings of the present invention.
Figure 3:
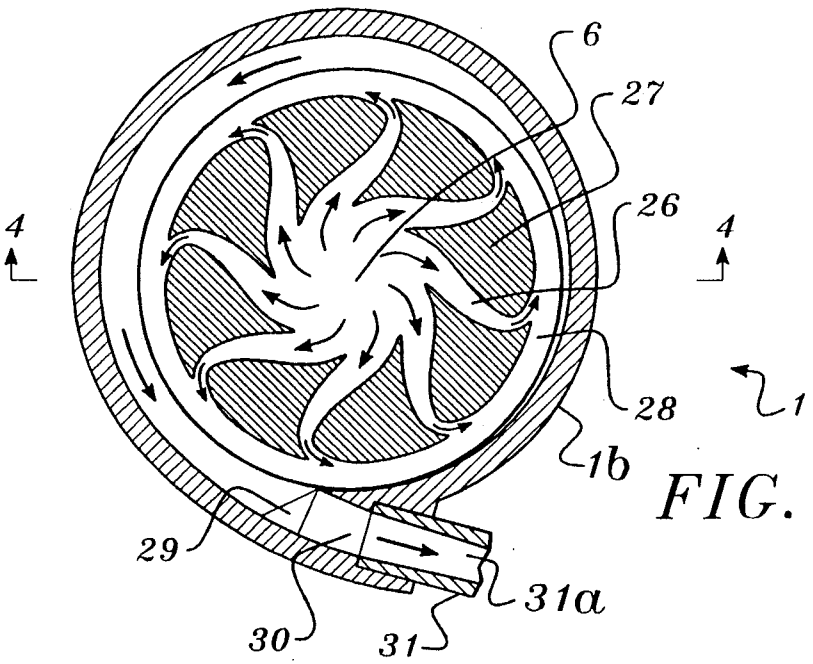
FIG. 3 shows the top cutaway view of the centrifugal pump in accordance with the teachings of the present invention.
Figure 5:
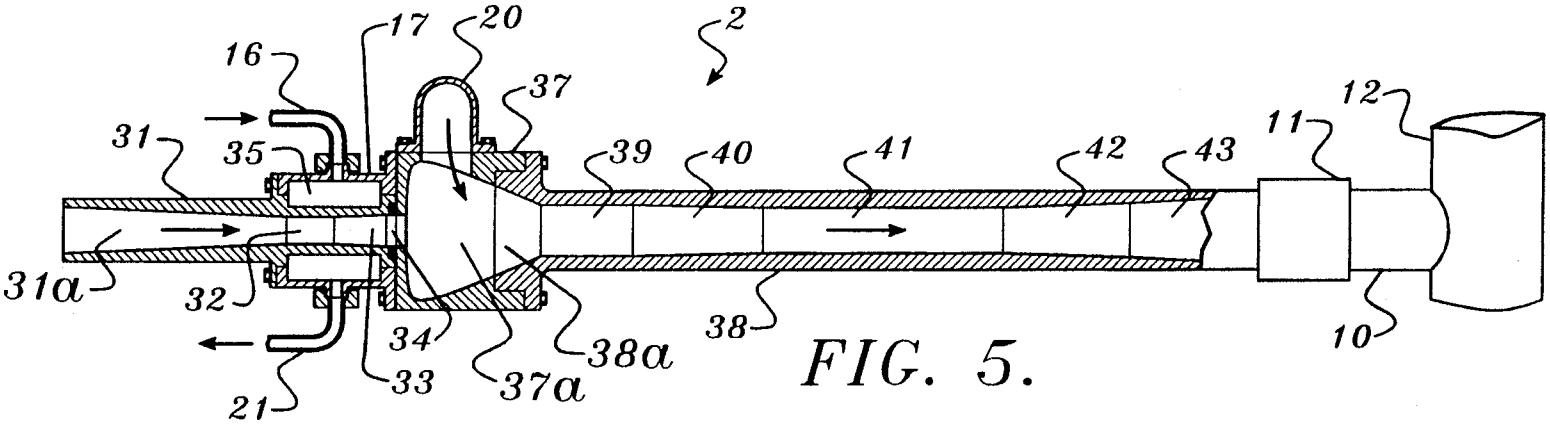
FIG. 5 shows a cutaway of the ejector used with this refrigeration system in accordance with the teachings of the present invention.

FIGS. 3 and 4

The refrigerant enters the centrifugal pump at (6). From there it is picked up by the vanes (27) and moves outward through passages (26). The passages are designed so that the refrigerant can and will be accelerated all of the way out. They have a backward slope to begin with so that the refrigerant will have a relatively gentle entry into the passages. The slope moves forward slowly as the liquid moves to the outer diameter. At the outer diameter the curve moves forward very rapidly and becomes a positive slope giving the liquid refrigerant moving through the passages a sling-shot effect or sudden acceleration. The vanes that form the passages are designed to apply a force on the refrigerant that is used to accelerate the fluid rather than increase its pressure. The vanes, starting with a backward slope, wedge the fluid outward. As the slope of the vanes moves forward, it gradually increases the centrifugal forces that are used to increase the fluid velocity through the passages (26). The greater distance from the center is doing this also. This force of the fluid moving into a smaller cross-section converts the force to velocity. The increase in velocity itself tends to increase this centrifugal force. The velocity in the passages is further increased by the pressure drop created by the suction of the ejector downstream of the pump.

In the outer passage (28) the quantity of the liquid increases starting just beyond the discharge point (29). The velocity also would be increasing as the quantity increases, not because of the increased quantity, but due to the pressure drop as the fluid in (28) moves toward the pump discharge (30). The vanes (27) are designed at the passages' (26) exit to allow the liquid entering the outer passage to accelerate as it enters. The outer passage would be sized to balance the quantity that the passages (26) are adding with the acceleration due to the pressure drop as the flow moves toward the high vacuum downstream of the pump.

(29) is the point where the flow either goes to the ejector or recirculates around the pump again. (30) becomes part of the ejector power jet. The flow never slows up from the time it enters the pump at (6) until it enters the ejector delivery jet. Every bit of energy goes toward accelerating the refrigerant that powers the ejector. Because the passages (26) are converging all the way out, cavitation experienced by conventional centrifugal pumps is virtually eliminated. Due to the fact that the refrigerant is accelerating from entrance (6) to the discharge of the ejector power jet, you avoid losses due to turbulence.

The super energy we give to the ejector allows us to attain vacuums that are not possible with present day ejectors while pumping.

EJECTOR

FIG. 5

Refrigerant enters the power jet at (31) and is being accelerated by the pressure drop to the suction vacuum. At (32) refrigerant is starting to absorb heat left over from the cooling coils and because of its low pressure is starting to form a gas. In forming a gas it gives the remaining liquid an extra push in the direction of the low pressure suction. At this point the converging taper is no longer necessary to get acceleration due to the increase in volume of the mixture off-setting the increase in velocity.

As the fluid passes through stage (33) the volume in increasing faster than the velocity which makes it necessary to have a diverging section.

At point (34) heat is no longer being added and the fluid pressure is already the same as that of the suction. We are no longer increasing the velocity of the fluid passing through the power jet and we would like to straighten the diverging flow to concentrate the power and to prevent de-acceleration. We, therefore, have a parallel section (34).

(35) is a heating jacket to extract some of the remaining heat of the refrigerant coming from the cooling coils.

(16) is the supply and (21) is the discharge for the heating jacket.

(37) is the section where the low pressure gas (steam) of the evaporator mixes with the high velocity fluid discharging from the power jet. This discharge will be a gas/liquid mixture. Due to the fact that there is a high density liquid moving at an extremely high velocity it won't slow up much when the very light suction gas is entrained into it. At that point it will not tend to spread very much.

(38*a*) is the entrance to the delivery jet and acts like a funnel. It needs to be large enough to handle all the spread of the discharge of the power jet at that point.

(39) is where the power jet flow with its entrained suction gas seals with the delivery jet. It would be parallel or having very little taper for there would be minimum back-pressure before de-acceleration. The condensing of the gas has not started yet. The diameter of section (39) represents the maximum divergence of the fluid from the power jet and the suction gas.

(40) is where we are starting compressing of the flow plus the condensing of the entrained gas due to the higher pressure. This section has a small converging taper to compensate for the fact that the volume is decreasing due to the condensing of gas. This would have a smaller and longer convergence than conventional ejectors.

(41) is where the decreasing velocity has caught up to the reduction in volume due to the condensing of the gas. It is parallel due to the above. The parallel is much longer than the delivery jet parallel of a conventional ejector because they do not anticipate these conditions.

(42) is where there is very little condensing of gas and the diverging taper is required to make room for the slower velocity of the flow. However, where the velocities are still substantial, the divergence needs to be small. We are back to normal ejector design practice.

(43) uses a greater taper because the velocities are smaller. The tapers from here just follow good desing practice.

(20) is the suction of the ejector. It is kept short with plenty of room to minimize loses to pressure drop caused by friction and elevation.

I claim:

1. A refrigeration cycle comprising an externally powered centrifugal pump which accelerates an ejector operating liquid mechanically through passages formed by the pump vanes wherein the converging passages start with a backward slope and have a major forward curve near the end of the discharge of the converging passages where the curve of the vanes become a positive forward slope, where the passages discharge into a chamber circling around the pump impeller, and the pump discharge discharges directly into the ejector operating jet where the liquid further accelerates in the ejector operating jet to the very high vacuum of the ejector suction, where it maintains the very high vacuum in the evaporator producing a refrigeration effect and the ejector discharge is returned to the pump and a little to the evaporator after cooling by a heat exchanger.

2. A regrigeration cycle comprising an externally powered centrifugal pump which accelerates an ejector operating liquid mechanically through passages formed by the pump vanes, wherein the converging passages start with a backward slope and have a major forward curve near the end of the discharge of the converging passage where the curve of the vanes become a positive forward slope where the passages discharge into a chamber circling around the pump impeller, where the discharge pressure is reduced from beyond the pump discharge to help accelerate the liquid moving through the pump and the pump discharge discharges directly into the ejector operating jet where the liquid further accelerates in the ejector operating jet to the very high vacuum of the ejector suction where it maintains the very high vacuum in the evaporator producing a refrigeration effect and the ejector discharge is returned to the pump and a little to the evaporator after cooling by a heat exchanger.

3. A refrigeration cycle comprising an externally powered centrifugal pump which accelerates an ejector operating liquid mechanically through passages formed by the pump vanes, wherein the converging passages start with a backward slope and have a major forward curve near the end of the discharge of the converging passages where the curve of the vanes become a positive forward slope where the passages discharge into a chamber circling around the pump impeller and the pump discharge discharges directly into the ejector operating jet where the liquid that is already moving at a very high velocity but with very little pressure is accelerated further by creating a very high vacuum in the ejector suction, using the high velocity to evacuate the suction as well as the evaporator producing a high pressure drop the high vacuum in the evaporator produces the refrigeration effect and the discharge from the operating jet would discharge into the ejector delivery jet and from there the ejector discharge returns to the pump and a little to the evaporator after cooling by a heat exchanger.

4. The refrigeration cycle according to claim 3 wherein heating means adds heat to the fluid at the power jet, causing flashing which further increases the velocity.

* * * * *